US009505418B2

(12) United States Patent
Nibouar et al.

(10) Patent No.: US 9,505,418 B2
(45) Date of Patent: Nov. 29, 2016

(54) USE OF NO-BAKE MOLD PROCESS TO MANUFACTURE RAILROAD COUPLERS

(71) Applicant: Bedloe Industries LLC, Wilmington, DE (US)

(72) Inventors: F. Andrew Nibouar, Chicago, IL (US); Jerry R. Smerecky, South Barrington, IL (US); Ronald P. Sellberg, Naperville, IL (US); Arthur A. Gibeaut, Erie, IL (US)

(73) Assignee: Bedloe Industries LLC, Wilmington, DE (US)

( * ) Notice: Subject to any disclaimer, the term of this patent is extended or adjusted under 35 U.S.C. 154(b) by 0 days.

(21) Appl. No.: 14/739,857

(22) Filed: Jun. 15, 2015

(65) Prior Publication Data

US 2016/0016595 A1 Jan. 21, 2016

Related U.S. Application Data

(63) Continuation of application No. 14/337,722, filed on Jul. 22, 2014, now Pat. No. 9,079,590, which is a continuation of application No. 13/916,114, filed on Jun. 12, 2013, now Pat. No. 8,783,481, which is a continuation of application No. 12/685,346, filed on Jan. 11, 2010, now Pat. No. 8,485,371.

(51) Int. Cl.

| | |
|---|---|
| ***B61G 3/04*** | (2006.01) |
| ***B22C 9/02*** | (2006.01) |
| ***B22C 9/22*** | (2006.01) |
| ***B22C 1/00*** | (2006.01) |

(52) U.S. Cl.
CPC . *B61G 3/04* (2013.01); *B22C 1/00* (2013.01); *B22C 9/02* (2013.01); *B22C 9/22* (2013.01)

(58) Field of Classification Search
CPC ..... B61G 3/00; B61G 3/04; B61G 3/06; B61G 3/08; B61G 1/00; B61G 7/00; B61G 7/10; B61G 7/14; B61G 9/24; B22C 9/22; B22C 9/02; B22C 9/04; B22C 9/10
See application file for complete search history.

(56) References Cited

U.S. PATENT DOCUMENTS 2,709,007 A 5/1955 Metzger
2,948,414 A * 8/1960 Metzger ..... 213/127

(Continued)

FOREIGN PATENT DOCUMENTS

CN 1366472 A 8/2002
CN 101010231 A 8/2007

(Continued)

OTHER PUBLICATIONS

"Air Set Casting", Butler Foundry, retrieved Oct. 7, 2009 from http://www.foundry-casting.co.uk/air-set-casting.html; 2 pp.

(Continued)

*Primary Examiner* — Jason C Smith
(74) *Attorney, Agent, or Firm* — Banner & Witcoff, Ltd.

(57) ABSTRACT

A railroad coupler assembly having at least a body and a knuckle both formed in a no-bake manufacturing process, the body and the knuckle having dimensional tolerances of distances between features that wear during operation that are about half those obtained from a body and a knuckle manufactured by a green sand process, resulting in increased fatigue life compared to the body and the knuckle manufactured by a green sand process.

26 Claims, 10 Drawing Sheets

(56) References Cited

U.S. PATENT DOCUMENTS

| | | | | |
|---|---|---|---|---|
| 3,168,202 | A | 2/1965 | Cope | |
| 3,206,039 | A | 9/1965 | Metzger | |
| 4,084,705 | A | 4/1978 | Oshinsky et al. | |
| 4,143,701 | A * | 3/1979 | Oshinsky et al. | 164/368 |
| 4,452,299 | A | 6/1984 | Gruber et al. | |
| 4,982,781 | A | 1/1991 | Carpenter et al. | |
| 5,424,376 | A * | 6/1995 | Chang et al. | 525/480 |
| 5,878,897 | A * | 3/1999 | Lazzaro et al. | 213/139 |
| 6,005,021 | A | 12/1999 | Chen et al. | |
| 6,796,448 | B1 | 9/2004 | Wilt et al. | |
| 7,337,826 | B2 * | 3/2008 | Mautino et al. | 164/137 |
| 7,757,871 | B2 | 7/2010 | Mautino et al. | |
| 2004/0173555 | A1 * | 9/2004 | Wilt et al. | 213/50 |
| 2007/0084818 | A1 * | 4/2007 | Brabb et al. | 213/100 R |
| 2008/0128377 | A1 * | 6/2008 | Mautino et al. | 213/75 R |
| 2009/0289024 | A1 * | 11/2009 | Nibouar et al. | 213/75 R |
| 2009/0294396 | A1 * | 12/2009 | Smerecky et al. | 213/75 R |
| 2010/0326943 | A1 | 12/2010 | Mautino et al. | |
| 2011/0068077 | A1 * | 3/2011 | Smyth | 213/155 |
| 2011/0168655 | A1 * | 7/2011 | Nibouar et al. | 213/100 R |

FOREIGN PATENT DOCUMENTS

| | | | |
|---|---|---|---|
| CN | 101600612 | A | 12/2009 |
| EP | 1060971 | A1 | 12/2000 |
| EP | 1531018 | A1 | 5/2005 |
| GB | 221961 | A | 9/1924 |
| GB | 355247 | A | 8/1931 |
| WO | 0181024 | A1 | 11/2001 |

OTHER PUBLICATIONS

"Air-Set (No Bake) Process", Bernier Cast Metals Inc., retrieved Oct. 7, 2009 from http://www.bernierinc.com/Air_Set.html; 1 page.
"Comparators for the Definition of Surface Quality of Steel Castings", Steel Castings Research and Trade Association, 1981 Scrata; 44 pp.
"Dimensional Capabilities of Steel Castings", SFSA Supplement 3, retrieved Jan. 12, 2010 from www.sfsa.org/sfsa/pubs/hbk/s3.pdf; 33 pp.
"Green Sand Molding", Bernier Cast Metals Inc., retrieved Oct. 7, 2009 from http://www.bernierinc.com/Green_Sand_Molding.html; 1 page.
"Precision Air-Set Casting Process", Armstrong Mold Corporation, retrieved Oct. 7, 2009 from http://www.armstrongmold.com/pages/airset.html; 2 pp.
"Sand Casting", Custom PartNet, retrieved Oct. 7, 2009 from http://www.custompartnet.com/wu/SandCasting; 7 pp.
"Standard Practice for Steel Castings", Feb. 1990, Surface Acceptance Standards, Visual Examination ASTM-A 802/A 802M,; 2 pp.
Aug. 16, 2011—(US) Office Action—U.S. Appl. No. 12/685,346.
Dec. 16, 2011—(WO) International Preliminary Report—App. PCT/US2011/020207.
Jul. 27, 2012—(US) Office Action—U.S. Appl. No. 12/685,346.
May 8, 2012—(US) Office Action—U.S. Appl. No. 12/685,346.
Feb. 25, 2013—(CN) Office Action—App. 200980122328.8.
Jan. 23, 2013—(US) Office Action—U.S. Appl. No. 12/685,346.
Jul. 3, 2014—(CN) Office Action—App. 201180005770.X.
Apr. 29, 2015—(CN) Office Action—App. 201180005770.X.
Aug. 17, 2015—(AU) Office Action—App. 2011203691.
Steel Castings Handbook, 6th Edition, Dec. 1995, Steel Founders' Society of America, ASM International, 4 pp.
Wikipedia, Chill (casting), retrieved Oct. 7, 2009 from http://en.wikipedia.org/wiki/Chill (foundry); 2 pp.
Wikipedia, Cope and Drag, retrieved Oct. 7, 2009 from http://en.wikipedia.org/wiki/Cop_and_drag; 1 page.
Wikipedia, Flask (casting), retrieved Oct. 7, 2009 from http://en.wikipedia.org/wiki/casting_flask; 1 page.
Wikipedia, Molding Sand, retrieved Oct. 7, 2009 from http://en.wikipedia.org/wiki/molding_sand; 1 page.
Wikipedia, No bake mold casting, retrieved Oct. 7, 2009 from http://en.wikipedioa.org/wiki/no_bake_mold_casting; 2 pp.
Wikipedia, Sand Casting, retrieved Oct. 7, 2009 from http://en.wikipedia.org/wiki/sand_casting; 10 pp.

* cited by examiner

USE OF NO-BAKE MOLD PROCESS TO MANUFACTURE RAILROAD COUPLERS

CROSS-REFERENCE TO RELATED APPLICATIONS

This patent application is a continuation of pending U.S. application Ser. No. 14/337,722 filed Jul. 22, 2014 entitled "Use of No-Bake Mold Process to Manufacture Railroad Couplers", which is a continuation of U.S. Pat. No. 8,783,481 issued Jul. 22, 2014 entitled "Use of No-Bake Mold Process to Manufacture Railroad Couplers", which is a continuation of U.S. Pat. No. 8,485,371 issued Jul. 16, 2013 entitled "Use of No-Bake Mold Process to Manufacture Railroad Couplers", all of which are incorporated herein by reference.

BACKGROUND

1. Technical Field

The present embodiments relate generally to the field of railroad couplers, and more specifically, to the manufacturing of railway couplers and their various parts through the use of no-bake or air-set casting.

2. Related Art

Sand casting is one of the earliest forms of casting. Its popular use is due to its low cost and the simplicity of materials involved. A sand casting or a sand molded casting is a cast part produced through the following process: (1) placing a pattern in sand to create a mold, which incorporates a gating system; (2) removing the pattern; (3) filling the mold cavity with molten metal; (4) allowing the metal to cool; (5) breaking away the sand mold and removing the casting; and (6) finishing the casting, which may include weld repair, grinding, machining, and/or heat treatment operations. This process is now explained in more detail.

In sand casting, the primary piece of equipment is the mold, which contains several components. The mold is divided into two halves—the cope (upper half) and the drag (bottom half), which meet along a parting line. The sand mixture is packed around a master "pattern" forming a mold cavity, which is an impression of the shape being cast. The sand is usually housed in what casters refer to as flasks, which are boxes without a bottom or lid, used to contain the sand. The sand mixture can be tamped down as it is added and/or the final mold assembly is sometimes vibrated to compact the sand and fill any unwanted voids in the mold. The sand can be packed by hand, but machines that use pressure or impact ensure even packing of the sand and require far less time, thus increasing the production rate. The pattern is removed, leaving the mold cavity. Cores are added as required, and the cope is placed on top of the drag.

Cores are additional pieces that form the internal openings, recesses, and passages of the casting. Cores are typically comprised of sand so that they can be shaken out of the casting, rather than requiring the necessary geometry to slide out. As a result, sand cores allow for the creation of many complex internal features. Each core is positioned in the mold before the molten metal is poured. Recesses in the pattern called core prints anchor each core in place. The core may still shift, however, due to poor fit up between core and core prints, the flow of the metal around the core, or due to buoyancy in the molten metal.

Small metal pieces called chaplets are fastened between the cores and the cavity surface to provide further support for the cores. Chaplets are small metal pieces that are fastened between the core and the cavity surface. Chaplets consist of a metal with a higher melting temperature than that of the metal being cast in order to maintain their structure to support the core. After solidification, the chaplets are cast inside the casting and the excess material of the chaplets that protrudes is cut off.

In addition to the external and internal features of the casting, other features must be incorporated into the mold to accommodate the flow of molten metal. The molten metal is poured into a pouring basin, which is a large depression in the top of the sand mold. The molten metal funnels out of the bottom of this basin and down the main channel, called the sprue. The sprue connects to a series of channels, called runners that carry the molten metal into the cavity. At the end of each runner, the molten metal enters the cavity through a gate that controls the flow rate and minimizes turbulence.

Chambers called risers that fill with molten metal are often connected to the runner system. Risers provide an additional source of metal during solidification. When the casting cools, the molten metal shrinks and the additional material in the gate and risers acts to back fill into the cavities as needed. Open risers also aid in reducing shrinkage. When open risers are utilized, the first material to enter the cavity is allowed to pass completely through the cavity and enter the open riser. This strategy prevents early solidification of the molten metal and provides a source of material to compensate for shrinkage. Lastly, small channels are included running from the cavity to the exterior of the mold. These channels act as venting holes to allow gases to escape the cavity. The porosity of the sand also allows some air to escape, but additional vents are sometimes needed. The molten metal that flows through all of the channels (sprue, runners, and risers) will solidify attached to the casting and must be separated from the part after it is removed. Molten metal is poured into the mold cavity, and after it cools and solidifies, the casting is separated from the sand mold.

The accuracy of the casting is limited by the type of sand and the molding process. Sand castings made from coarse green sand impart a rough texture on the surface of the casting, making them easy to distinguish from castings made by other processes. Air-set, or no-bake, molds can produce castings with much smoother surfaces. The benefit to providing a smoother surface is discussed in more detail below but is not insignificant in improving the performance of castings made utilizing the air-set casting process. After molding, the casting is covered in a residue of oxides, silicates, and other compounds. This residue can be removed by various means, such as grinding or shot blasting. Several other surface condition benefits result from the use of the air-set process compared to the green sand process. These include benefits with regards to surface inclusions, surface porosity, laps, and scabs. Details of a comparison between required surface conditions and what can be obtained using the air-set process are provided below.

During casting, some of the components of the sand mixture are lost in the thermal casting process. Green sand can be reused after adjusting its composition to replenish the lost moisture and additives. The pattern itself can be reused indefinitely to produce new sand molds. The sand molding process has been used for many centuries to produce castings manually. Since 1950, partially-automated casting processes have been developed for production lines, some including hydraulics to compact the sand.

Green sand is an aggregate of sand (about 90%), bentonite clay or binder (about 7%), which includes pulverized coal, and water (about 3%). It is termed "green" because like a green tree branch, it contains water. The largest portion of the aggregate is always sand, which can be either silica or olivine. There are many recipes for the proportion of clay, but they all strike different balances between moldability, surface finish, and ability of the hot molten metal to degas. The coal, typically referred to in foundries as sea-coal, is present at a ratio of less than 5% and partially combusts in the presence of the molten metal leading to off-gassing of organic vapors. Also, the presence of 2-3% water results in increased occurrence of gas defects in the casting after reacting with the molten steel. Rough surface discontinuities can form as a result of the off gassing or vapors and can result in lower fatigue life for couplers and coupler parts. Given the cyclic loading to which coupler assemblies are subjected, it is important to provide as long a fatigue life as possible.

Another type of mold is a skin-dried mold. A skin-dried mold begins like a green sand mold, but additional bonding materials are added and the cavity surface is dried by a torch or heating lamp to increase mold strength. This improves the dimensional accuracy and surface finish, but lowers the collapsibility. Dry skin molds are more expensive and require more time, thus lowering the production rate.

Another type of sand that may be used in sand casting is dry sand. In a dry sand mold, sometimes called a cold box mold, the sand is mixed only with an organic binder. The mold is strengthened by baking it in an oven. The resulting mold has a high dimensional accuracy, but is expensive and results in a lower production rate.

The casting process for the manufacture of couplers has historically employed the green sand process. While this process has served the railroad industry well, there are disadvantages associated with the green sand process, such as poor material strength, porosity, and poor surface finish, resulting in shorter fatigue life, large tolerance variation, and secondary grinding/machining is often required after the casting process. Additionally, a large number of weld repairs may be required at finishing time to fix either surface or subsurface defects. Production rates are also low and include high finishing labor costs. For reasons that will become more apparent below, these disadvantages can require earlier replacement of couplers and/or knuckles, and create additional manufacturing costs that can be avoided. It would be beneficial, therefore, to use another casting process in the manufacture of railroad coupler assemblies to overcome, or at least ameliorate, these disadvantages.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

Figure 1:
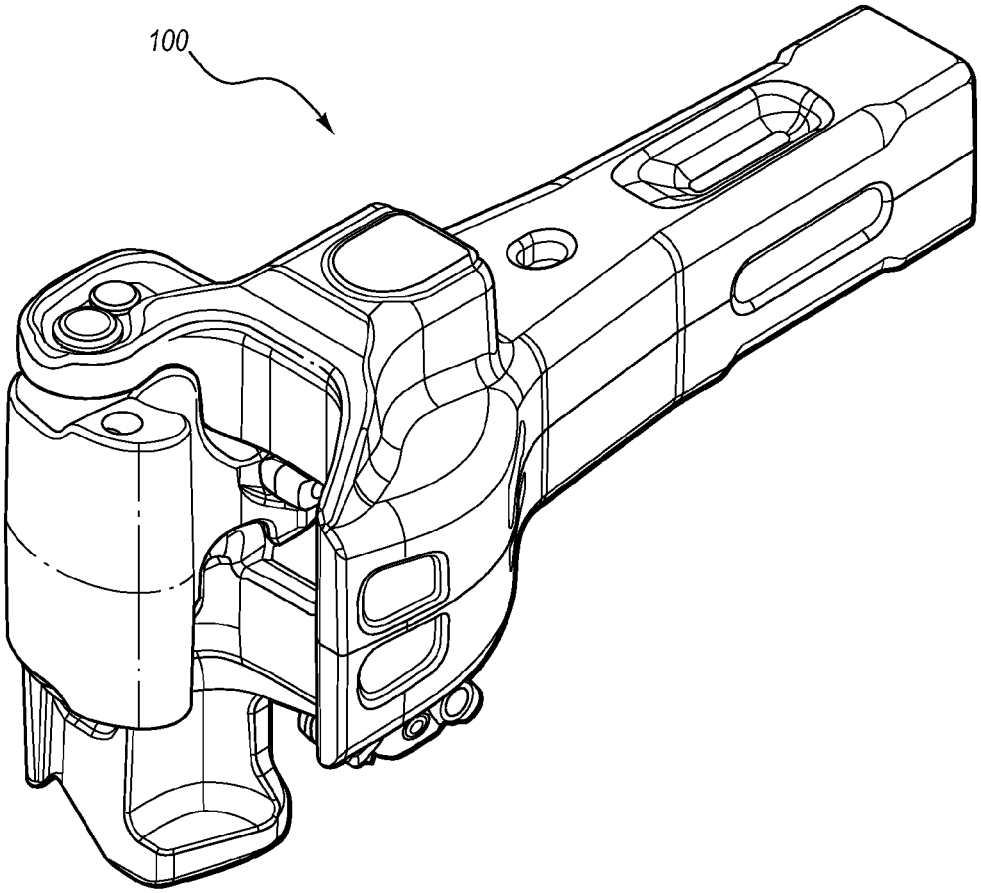
FIG. 1 is a perspective view of a railroad coupler manufactured by a no-bake, or air-set, process.

Many of the disadvantages of using the green sand process discussed above can be overcome, or at least ameliorated, by using a no-bake, or air-set, casting process. "No-bake" and "air-set" refer to the same type of process and are considered interchangeable throughout this disclosure. The Association of American Railroads (AAR) coupler 100, shown in FIG. 1, is an assembly of parts, all of which are required to interact in a precise manner for the coupler assembly to operate properly and to have optimum part life. Operating positions include locked, unlocked, and lockset. Since coupler parts are often replaced during the service life of a coupler, the interchange of parts must maintain the proper interfacing dimensions for proper operation. Therefore, control of the dimensional characteristics of coupler parts is important to ensure proper operation.

The coupler also transmits the longitudinal forces pulling and pushing a railcar in service operations. These forces can be of significant magnitude-often many hundreds of thousands of pounds—and require that the load path of force through the coupler assembly be precisely controlled.

Design loads per the AAR Specification M-211 reach 650,000 pounds for the knuckle and 900,000 pounds for the coupler body. Uniform loading helps ensure uniform wear patterns and in turn more uniform load distribution. Finally, the strength of the coupler and its fatigue life is important in order to prevent premature failure of parts, which is directly influenced by dimensional consistency and consequently the level of uniform load distribution.

Surface finish or texture of the coupler has a definite effect in maintaining the required coupler strength and fatigue life. The no-bake casting process provides better dimensional control, improved load path for operating forces, more uniform wear patterns, castings with fewer weld repairs, and improved surface texture for improved strength and fatigue life compared to the green sand process.

In no-bake mold casting, molten metal is poured into a non-reusable mold made from a mixture of sand, quick-setting resin, and catalyst, and the mold is held together until solidification occurs. No-bake sand molding produces a sand mold of considerable strength, which can be free standing without the need for a traditional, steel flask and therefore unlimited in size and shape. The traditional flask is heavy and rigid, which limits green sand operations by the molding efficiencies that result from the limitations of metal flasks.

The no-bake casting process involves the use of chemically-bonded sand systems. The use of the chemical bonding agents typically makes the no-bake process somewhat more expensive than the green sand process. As part of the no-bake casting process, a resin and catalyst are mixed together. Examples of gas catalysts used for curing include sodium silicate (C02), amine, S02, and ester cured phenolic systems. Examples of a liquid catalyst can include the air-set system. Through a chemical reaction, the resin hardens into a very strong bond. Sometimes an accelerator may be added to speed the hardening process. The no-bake casting process can also be less sensitive to the air temperature and moisture as compared to green sand operations.

The no-bake process uses graded kiln dried sand, which is mechanically mixed with a resin (or binder) to bind the sand together. Most binder systems are variations on a few basic chemicals, such as furan, phenolic urethane, and sodium silicate. Usually the no-bake method of forming the mold is accomplished at room temperature. Therefore, unlike the green sand process that requires curing the sand, water, and clay mixture at elevated temperature, the no-bake process derives its name by eliminating the baking process required when using the green sand method.

A chemical hardener is then added to the sand mix, which reacts with the binder and begins to set the sand into a solid form. At this point, the fluid sand is poured into a mold around a pattern or multiple patterns. Once poured, the sand is left to set. The binder causes the sand particles to bond together forming a very stable and accurate shape for the cavity that will be used to pour the final casting. Setting time depends on the type of hardener used. The sand sets into a solid block from which the pattern equipment is drawn. Cores are then added to the mold and the mold is closed and ready for casting.

Refractory coatings can be applied to resin-bonded cores and molds. These coatings are sometimes referred to as a wash. Coatings can be used for several reasons, including: (1) to improve surface finish; (2) to control the heat transfer characteristics and microstructure in the steel casting; (3) improve venting of a core; and (4) to prevent certain types of defects in the casting.

In contrast to the green sand process, as discussed, this hardened mold does not require the use of a traditional fabricated metal flask. Flask size limitations can be a detriment for the green sand process by preventing the manufacturer from varying the number of multiple parts in a single flask or by limiting the size of a single casting that can fit in a given flask because of the pre-existing fabricated metal flask sizes. Heavy, steel flasks cannot be cost-effectively modified to accommodate new customer parts sizes, if different than presently-used flasks. Purchasing various single flasks can become costly. Typical sizes can range up to four feet wide, six feet long, and depths from 18-24 inches deep for both cope and drag. Accordingly, an air-set mold is well-suited to larger, heavier castings as the mold strength allows casting of greater weights of metal. A solid sand structure allows a mold to be formed of various sizes, producing the best yields available for each solid sand structure. Also, sand use for a mold can be kept to a minimum without compromising quality so production costs are reduced. The chemical bonding of the sand particles for the no-bake process provides for a better surface condition compared to the green sand process where water and clay are used as the bonding agents.

State-of-the-art foundry equipment on modem-day air-set lines allows up to 100% reclamation of the primary raw material, sand. This reclaimed sand is broken down, cooled and filtered, to be used repeatedly. To maintain sand quality and mold strength, the reclaimed sand is mixed with new sand at a ratio of 75%:25%. This process keeps production costs to a minimum without compromising quality. Note that the new sand to reclaim sand ratio varies depending on the typical casting geometry and weight; the ratio of 75%:25% is only a typical value. Industry values range from 95%:5% to 40%:60%.

Some characteristics and advantages that distinguish the no-bake mold process from that of other sand molding processes, such as the green sand process, include: molds are chemically cured at room temperature; the process produces precise and repeatable dimensions; and finishing labor costs and scrap are reduced while obtaining high casting yields.

As a measure of the dimensional stability of the no-bake process compared to the green sand process, the Steel Founders' Society of America publishes values for dimensional tolerances in Supplement 3 of their Steel Casting Handbook. Base tolerances for castings made by the no-bake process are listed as plus or minus 0.020 inches compared to plus or minus 0.030 inches for castings made by the green sand process. While these are both small dimensions, the ability to have tolerances with a reduction in range of one third is significant when it comes to assuring proper load paths and operational characteristics of coupler assemblies as explained above. The tolerances of the coupler parts depends on casting weight and dimension as will be discussed below, so the tolerance achievable with the no-bake process when compared to the green sand process varies across different parts and dimensions of the railroad coupler. In all cases, however, the tolerances achievable with the no-bake process are smaller than the tolerances required by the AAR Specification M-211.

The no-bake process also allows for smaller draft angles than the green sand process. A draft angle refers to the small slope included for the vertical surfaces of the casting pattern, as oriented in the mold box, so that the pattern can be drawn away from the mold. The draft angle must be included both in the top of the cope and the drag portions of the patterns. Where the green sand process requires a draft angle of 1.5 degrees or more for typical shapes, the no-bake process requires only a 1.0 degree draft angle. Where the green sand (manual) process requires a draft angle of 2.0 degrees or more for deep pockets, the no-bake process requires only a 1.5 degree draft angle for deep pockets. The required draft angle of the green sand process results in a significantly greater deviation from the nominal dimension at cast points that are farther from the pointing line of the entire casting than a casting produced by the no-bake process. Smaller draft angles can promote better part loading and increase bearing area. This small difference is significant when accounting for the interfacing of the complicated shapes that make up the parts in a coupler assembly, and when combined with the reduced tolerance range.

Figure 2:
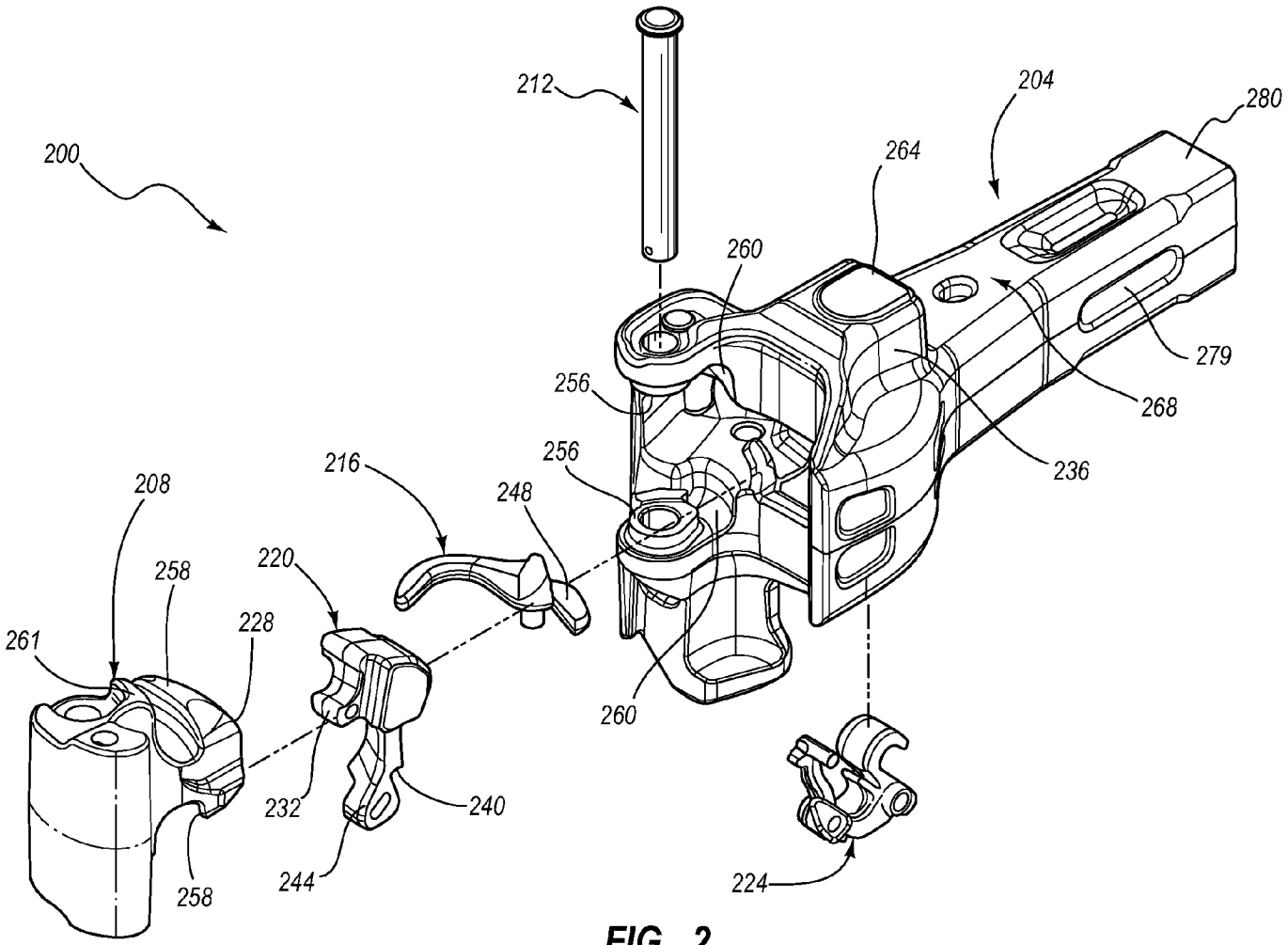
FIG. 2 is a perspective, exploded view of a coupler assembly used to form the railroad coupler of FIG. 1.

FIG. 2 displays the major parts of a railroad coupler assembly 200, including a body 204, a knuckle 208, a knuckle pin 212, a thrower 216, a lock 220, and a locklift 224. Of these major parts, the knuckle 208 and the body 204 are usually produced using the green sand casting process. Due to their small sizes, the lock 220, the thrower 216, and the locklift 224 assembly can be produced by various methods. The thrower 216 can also be produced by the green sand casting process or by the forging process. The present disclosure contemplates forming the body and knuckle utilizing the no-bake or air-casting process for all of the above-discussed reasons.

During the locking and unlocking operations, the knuckle 208 rotates about the axis of the knuckle pin 212. The knuckle tail 228 must pass under the knuckle shelf seat 232 on the lock 220 during the locking and unlocking operations. The lock must also move downward and upward in a lock chamber 236 of the body 204 during the locking and unlocking operations. Also, during lockset, the lock 220 must move upward in the lock chamber 236 of the body such that a lockset seat 240 on a lock leg 244 sits with precision on a leg-lock seat 248 of the thrower 216.

The parts of the coupler assembly 200 should have accurate dimensional characteristics to ensure successful operation. The better the dimensional characteristics, the smoother the operation. The larger the dimensional variation, the rougher the operation, and if large enough, the parts will jam and the coupler may become inoperable. Smooth surface finishes also aid in successful operation, which will be discussed in more detail below. If the tolerances of the parts are too large, interference can occur when the knuckle 208 is rotating relative to the body 204 and the lock 220. This interference can result in sticking conditions making difficult the operations of locking and unlocking the coupler. In some cases, extremes of tolerances in relative part dimensions have resulted in coupler inoperability and/or an inability to interchange parts.

Figure 4:
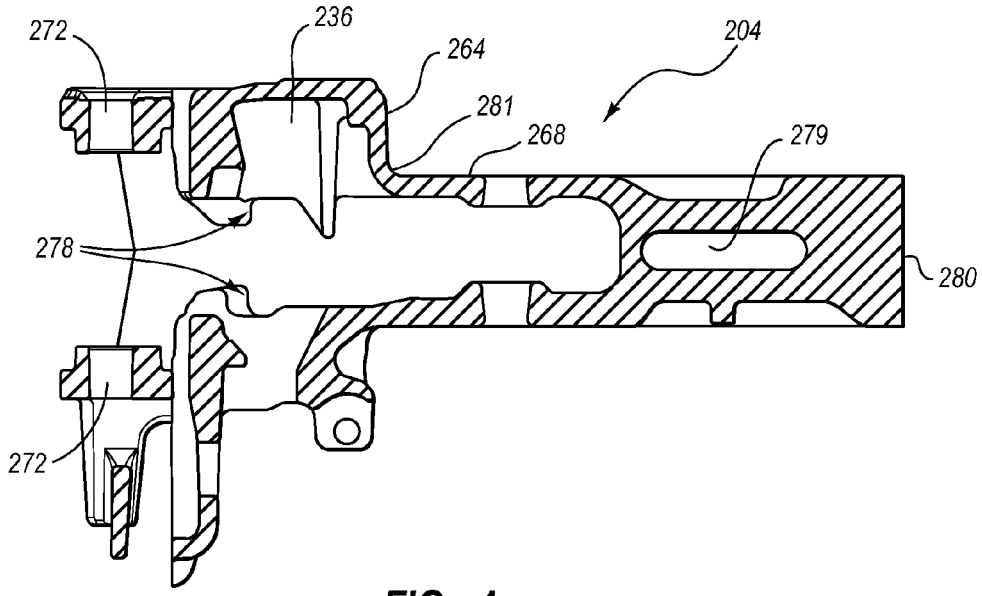
FIG. 4 is a side, cross section view along line 4-4 of the coupler body of FIG. 2.

The coupler load path for draft (pull) and buff (push) forces generated during train operations is also dependent on precise control of dimensional tolerances of the coupler parts. For draft forces, the coupler is designed to receive the pulling forces at the pulling faces 252 of the knuckles 208 (shown in FIGS. 14A, 14B) between two mating couplers. This pulling force is transmitted through the knuckle 208 to pulling lugs 258 at the knuckle tail 228. At that point, the pulling force is transmitted by the pulling lugs 278 of the coupler body 204 as best seen in FIG. 4. Finally, the pulling forces are transmitted through the coupler body 204 through a key slot 279 or the butt 280 of the coupler 204 to the draft system of the freight car and on through the car body to the other end of the car. If the tolerances of the coupler parts do not provide for the load path as described above, the pulling forces can be transmitted through the knuckle 208 to pin protector bosses 256 of the coupler body 204, to the knuckle pin 212, and/or unevenly between the top and bottom pulling lugs 258, 278, which results in uneven and expedited wear on these parts. Additionally, loads can be transmitted unevenly between mating coupler parts resulting in unequal loading. When the intended load path changes or there is unequal loading between the top and bottom pulling lugs 278, premature failure or reduced part life can occur in the coupler body 204, the knuckle pin 212, and/or the knuckle 208.

Buff forces are maxed during switching operations when freight cars impact each other. The coupler assembly is designed to react to the buff forces at the buffing shoulders 260 of the coupler body 204 and at the buffing shoulders 261 of the knuckle 208. If tolerances of the coupler parts are not controlled accurately, buffing forces can be transmitted at the pin protector bosses 256, 286 (see FIGS. 6, 15A, 15B), the knuckle pin 212, or unequally between the top and bottom buffing shoulders 260, 261 of the body 204 and the knuckle 208, respectively. Damage can thus occur, and result in the premature failure of the knuckle 208, the knuckle pin 212, and/or the coupler body 204. Therefore, it is advantageous to minimize dimensional tolerances so that proper load paths are maintained throughout the coupler assembly. These proper load paths promote uniform wear patterns.

While the green sand casting process has been used successfully for many years to produce coupler parts, the no-bake casting process results in a better surface finish and therefore can reduce cracking and associated issues that are created when surface conditions are less than optimal. The normally higher costs associated with the no-bake process have been minimized or offset by: reducing casting finishing (gauging) time, spending less capital investment on items such as special flasks that are not required, requiring less casting defect weld repair, reducing processing time, and yielding more dimensionally-consistent and higher-quality parts with improved part life.

The creation of good surface finish or texture has been established as a priority by the American Association of Railroads (AAR) through action taken by their Coupling Systems and Truck Castings Committee. In the past, certain surface conditions, such as sand inclusions and seams, have been found in critical areas of coupler parts. In some cases, surface conditions can result in cracks which result in reduced fatigue life of the coupler or knuckle. For instance, a radius area 281 between the coupler horn 264 and the shank 268 has received the attention of the Federal Railroad Administration. See Code of Federal Regulations, Title 49, 215.123. Cracks in this area now require replacement of the coupler. Furthermore, a smoother surface achievable through use of the no-bake process adds to tighter tolerances, which will be further discussed below. A part made with tighter tolerances has better fit and functions better with their mating parts, which also increases fatigue life.

In the effort to make sure surface conditions do not result in premature coupler failure, the Coupling Systems and Truck Castings Committee has included specific surface finish criteria as a part of the AAR Specification M-211. *Foundry and Product Approval Requirements for the Manufacture of Couplers, Coupler Yokes, Knuckles, Follower Blocks, and Coupler Parts*, Specification M-211, Last Adopted October 2009. Section 11.2 of the AAR Specification M-211 reviews specific surface acceptance levels, which are defined utilizing Steel Castings Research and Trade Association (SCRATA) *Comparators for the Definition of Surface Quality of Steel Castings*. The SCRATA comparators are nine categories, each with five quality levels, decreasing from 1 to 5, in which level 1 is the highest quality and level 5 is the poorest:

A. Surface Roughness—the natural surface of the casting after shot blasting.

B. Surface Inclusions—non-metallic material trapped on the casting surface.

C. Gas Porosity—indications of gas at the casting surface.

D. Laps and Cold Shuts—surface irregularities giving a wrinkled appearance.

E. Scabs—slightly raised surface irregularities.

F. Chaplets—indications of chaplets or internal chills.

G. Surface Finish—Thermal Dressing—surface remaining after using oxy-gas or air-carbon arc processes for metal removal.

H. Surface Finish—Mechanical Dressing—surface remaining after using a mechanical means of dressing a cast surface or a previously thermally dressed surface.

J. Welds—indications of welds fully or partially removed by thermal or mechanical dressing.

The following Tables 1 and 2 are comparison charts respectively for the coupler 204 and knuckle 208 that show the minimum surface conditions required by the AAR Specification M-211 and the improved surface conditions achievable using the no-bake process. Figure A.11 referred to in Table 1 is a three-page figure shown in Appendix A of the AAR Specification M-211 in which the shaded areas are the critical areas and the non-shaded areas are the non-critical areas. One of ordinary skill in railroad couplers would know to refer to Figure A.11 to determine which areas are currently considered critical as distinguished from non-critical areas by the AAR. In general, however, the critical areas are those areas that take on more load force with regards to the draft and buff forces discussed above and also those areas that interface or wear with other parts.

TABLE 1

COUPLER BODY

| Category | Critical Area (FIG. A.11) | With No-Bake | Non-Critical Area (FIG. A.11) | With No-Bake |
|---|---|---|---|---|
| A) Surface Roughness | A3 | A1 | A3 | A1 |
| B) Surface Inclusions | B2 | B2 | B4 | B3 |
| C) Gas Porosity | C2 | C2 | C3 | C2 |
| D) Laps | D1 | D1 | D4 | D1 |
| E) Scabs | E2 | E1 | E2 | E1 |
| F) Chaplets | F2 | F1 | F4 | F1 |
| G) Thermal Dressing | G2 | G1 | G3 | G1 |
| H) Mechanical Dressing | H3 | H1 | H4 | H1 |
| J) Welds | J2 | J1 | J3 | J1 |

The data in Table 1 was obtained through visual comparison of a number of coupler bodies 204 produced by the no-bake process with SCRATA plates representing 1 through 5 in each of the above categories. With reference to categories D through J in Table 1, no laps, scabs, chaplets, or welding were observed. Also, surface conditions of Thermal Dressing and Mechanical Dressing do not depend on the casting process, but result from an individual performing surface conditioning after the casting process has been completed. The frequency with which Thermal and Mechanical Dressing operations must be performed is, however, a result of the casting process, so a comparison with the green sand process is still helpful. As indicated, the surface quality of a coupler produced by the no-bake process is superior in just about every category, and at least equal to the minimum requirements under the AAR Specification M-211.

The data in Table 2 was obtained through visual comparison of a number of knuckles 208 produced by the no-bake process with SCRATA plates representing 1 through 5 in each of the above categories. With reference to categories D through J in Table 1, no laps, scabs, chaplets, or welding were observed. As with the coupler, the surface quality of the knuckles was superior in almost every category, or at least equal to the minimum requirements under the AAR Specification M-211.

TABLE 2

KNUCKLE

| Category | Critical Area (FIG. A.11) | With No-Bake | Non-Critical Area (FIG. A.11) | With No-Bake |
|---|---|---|---|---|
| A) Surface Roughness | A3 | A1 | A3 | A1 |
| B) Surface Inclusions | B2 | B2 | B4 | B3 |
| C) Gas Porosity | C2 | C2 | C3 | C2 |
| D) Laps | D1 | D1 | D4 | D1 |
| E) Scabs | E2 | E1 | E2 | E1 |
| F) Chaplets | F2 | F1 | F4 | F1 |
| G) Thermal Dressing | G2 | G1 | G3 | G1 |
| H) Mechanical Dressing | H3 | H2 | H4 | H2 |
| J) Welds | J2 | J1 | J3 | J1 |

The no-bake process may be used to manufacture the coupler body 204, the knuckle 208, the lock 220, the thrower 216, and the locklift 224 in such a way that better (smaller) tolerances for various relative dimensions are achieved due to the no-bake process. As discussed above, tolerances for the no-bake process is plus or minus 0.020 inches and the draft angle is about one (1.0) degree or less for typical features. Actual tolerances, however, vary with weight and dimension of the casted parts according to the Steel Founder's Society of America (SFSA) Tolerance Tables. Table 3 below shows the T3 tolerances used for the no-bake process used by the manufacturers. For comparison, Table 4 shows the TS tolerances that correspond to the green sand process typical of conventional railroad couplers.

TABLE 3

NO-BAKE TOLERANCES
Tolerances (±inches) for Tolerance Grade T3
CASTING WEIGHT - LBS

| L* | 2 | 5 | 10 | 20 | 50 | 75 | 100 | 150 | 200 | 250 | 500 | 750 | 1000 | 1250 | 1500 | 2000 | 3000 | 4000 | 5000 |
|---|---|---|---|---|---|---|---|---|---|---|---|---|---|---|---|---|---|---|---|
| .5 | .024 | .026 | .028 | .031 | .030 | .039 | .041 | .044 | .047 | .040 | .057 | .063 | .068 | .071 | .075 | .081 | .090 | .097 | .103 |
| 1.0 | .028 | .031 | .033 | .036 | .041 | .043 | .045 | .049 | .051 | .054 | .062 | .068 | .072 | .076 | .079 | .085 | .004 | .101 | .108 |
| 2.0 | .034 | .036 | .030 | .041 | .046 | .049 | .051 | .051 | .057 | .059 | .068 | .078 | .078 | .082 | .085 | .091 | .100 | .107 | .113 |
| 4.0 | .041 | .044 | .046 | .049 | .054 | .056 | .058 | .062 | .064 | .067 | .075 | .081 | .085 | .080 | .092 | .098 | .107 | .114 | .121 |
| 6.0 | .046 | .049 | .051 | .054 | .059 | .061 | .063 | .067 | .060 | .072 | .080 | .086 | .090 | .094 | .097 | .103 | .112 | .120 | .126 |
| 8.0 | .050 | .033 | .055 | .058 | .063 | .065 | .057 | .071 | .073 | .076 | .084 | .099 | .094 | .098 | .101 | .107 | .116 | .124 | .130 |

TABLE 3-continued

NO-BAKE TOLERANCES
Tolerances (±inches) for Tolerance Grade T3
CASTING WEIGHT - LBS

| L* | 2 | 5 | 10 | 20 | 50 | 75 | 100 | 150 | 200 | 250 | 500 | 750 | 1000 | 1250 | 1500 | 2000 | 3000 | 4000 | 5000 |
|---|---|---|---|---|---|---|---|---|---|---|---|---|---|---|---|---|---|---|---|
| 10.0 | .054 | .056 | .058 | .061 | .066 | .069 | .071 | .074 | .077 | .079 | .087 | .093 | .098 | .101 | .105 | .111 | .120 | .127 | .133 |
| 15.0 | .061 | .063 | .065 | .068 | .073 | .076 | .078 | .081 | .084 | .086 | .094 | .100 | .105 | .108 | .112 | .117 | .127 | .134 | .140 |
| 20.0 | .066 | .069 | .071 | .074 | .078 | .081 | .083 | .087 | .089 | .091 | .100 | .105 | .110 | .114 | .117 | .123 | .132 | .139 | .145 |
| 30.0 | .075 | .077 | .079 | .082 | .087 | .090 | .002 | .095 | .098 | .100 | .108 | .114 | .119 | .123 | .126 | .132 | .141 | .148 | .154 |
| 40.0 | .082 | .084 | .086 | .080 | .094 | .097 | .099 | .102 | .105 | .107 | .115 | .121 | .126 | .129 | .138 | .139 | .148 | .155 | .161 |
| 50.0 | .088 | .090 | .092 | .095 | .109 | .103 | .105 | .108 | .111 | .113 | .121 | .127 | .131 | .135 | .139 | .144 | .154 | .161 | .167 |
| 60.0 | .098 | .095 | .097 | .100 | .105 | .108 | .110 | .113 | .116 | .118 | .126 | .132 | .137 | .140 | .144 | .150 | .159 | .166 | .172 |

*Dimension Length in Inches

TABLE 4

GREEN SAND TOLERANCES
Tolerances (±inches) for Tolerance Grade T5
CASTING WEIGHT - LBS

| L* | 2 | 5 | 10 | 20 | 50 | 75 | 100 | 150 | 200 | 250 | 500 | 750 | 1000 | 1250 | 1500 | 2000 | 3000 | 4000 | 5000 |
|---|---|---|---|---|---|---|---|---|---|---|---|---|---|---|---|---|---|---|---|
| .5 | .038 | .045 | .052 | .061 | .076 | .068 | .002 | .103 | .111 | .118 | .145 | .163 | .178 | .190 | .201 | .210 | .248 | | |
| 1.0 | .042 | .049 | .057 | .066 | .081 | .090 | .096 | .107 | .116 | .123 | .149 | .167 | .182 | .194 | .205 | .224 | .253 | .276 | .296 |
| 2.0 | .048 | .055 | .082 | .071 | .087 | .095 | .102 | .113 | .121 | .129 | .155 | .173 | .188 | .200 | .211 | .229 | .259 | .282 | .301 |
| 4.0 | .055 | .062 | .070 | .079 | .094 | .103 | .109 | .120 | .129 | .135 | .162 | .180 | .195 | .207 | .218 | .237 | .266 | .289 | .309 |
| 6.0 | .060 | .068 | .075 | .084 | .099 | .108 | .114 | .125 | .134 | .141 | .167 | .186 | .200 | .213 | .223 | .242 | .271 | .294 | .314 |
| 8.0 | .064 | .072 | .079 | .088 | .103 | .112 | .118 | .129 | .138 | .145 | .171 | .190 | .204 | .217 | .227 | .246 | .275 | .298 | .318 |
| 10.0 | .068 | .075 | .082 | .091 | .107 | .116 | .122 | .133 | .141 | .148 | .175 | .193 | .208 | .220 | .231 | .249 | .278 | .302 | .321 |
| 15.0 | .075 | .082 | .089 | .098 | .113 | .122 | .129 | .140 | .148 | .155 | .181 | .200 | .215 | .227 | .238 | .256 | .285 | .308 | .328 |
| 20.0 | .080 | .087 | .094 | .103 | .119 | .127 | .134 | .145 | .154 | .161 | .187 | .205 | .220 | .232 | .243 | .262 | .291 | .314 | .334 |
| 30.0 | .089 | .096 | .103 | .112 | .128 | .136 | .143 | .150 | .162 | .169 | .196 | .214 | .229 | .241 | .252 | .270 | .299 | .323 | .342 |
| 40.0 | .096 | .103 | .110 | .112 | .135 | .148 | .150 | .161 | .169 | .176 | .203 | .221 | .236 | .248 | .259 | .277 | .306 | .330 | .349 |
| 50.0 | .102 | .109 | .116 | .125 | .140 | .149 | .156 | .166 | .175 | .182 | .208 | .227 | .241 | .254 | .265 | .283 | .312 | .335 | .355 |
| 60.0 | .107 | .114 | .121 | .130 | .146 | .164 | .161 | .172 | .180 | .187 | .214 | .232 | .247 | .259 | .270 | .288 | .317 | .341 | .360 |

*Dimension Length in Inches

By way of a simple example, suppose a casted part is made by both the no-bake and the green sand processes, both that weigh about 100 pounds. Suppose a dimension of interest is about 2.0 inches. The tolerance achievable by the no-bake process is about 0.051 inches while the tolerance of the part made by the green sand process is about 0.102, which is about twice that achievable by the no-bake process.

Figure 3:
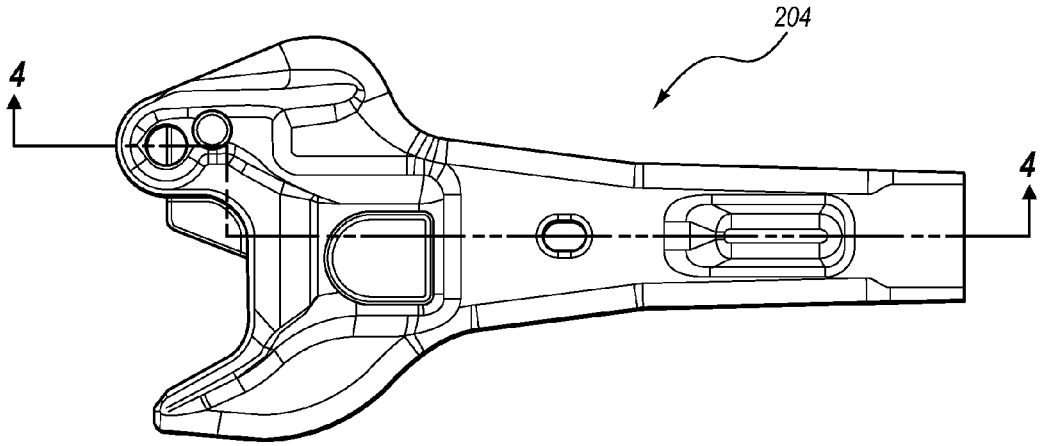
FIG. 3 is a top perspective view of the coupler body of FIG. 2.

FIG. 3 is a top perspective view of the coupler body 204 of FIG. 2. FIG. 4 illustrates a side, cross section view along line 4-4 of the coupler body 204 of FIG. 2, including coupler pin holes 272 through which the knuckle pin 212 is inserted, and pulling lugs 278 of the coupler body 204 that correspond to the pulling lugs 258 of the knuckle 208. The balanced loading achievable through the no-bake process results in more even wearing at the pulling lugs 278 of the coupler body, thus extending the fatigue life of the coupler body. The tolerances achievable, discussed below, using the no-bake process for dimensions define the location of the body pulling lugs 278 relative to the coupler pin holes 272.

Figure 5A:
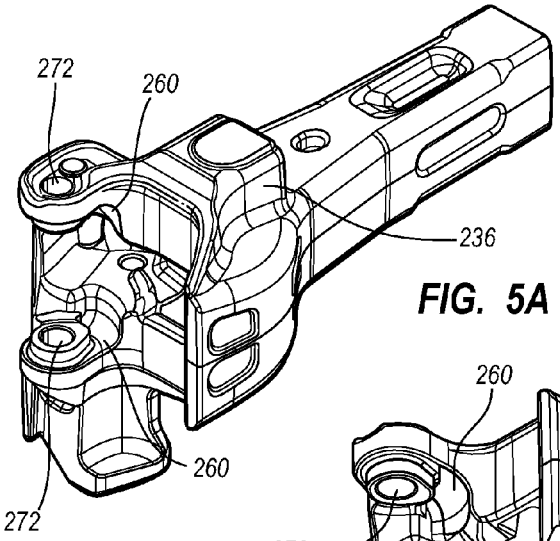
FIGS. 5A and 5B are two perspective views of the coupler body of FIG. 2, showing the location of the coupler buffing shoulders relative to the coupler pin hole.
Figure 5B:
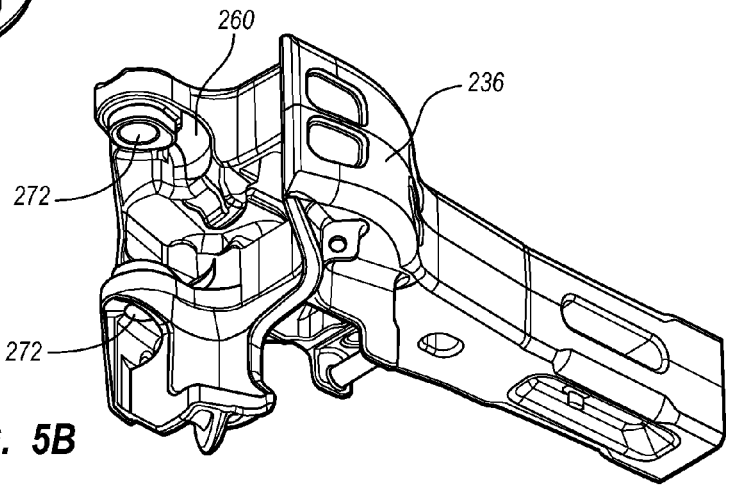
Figure 6:
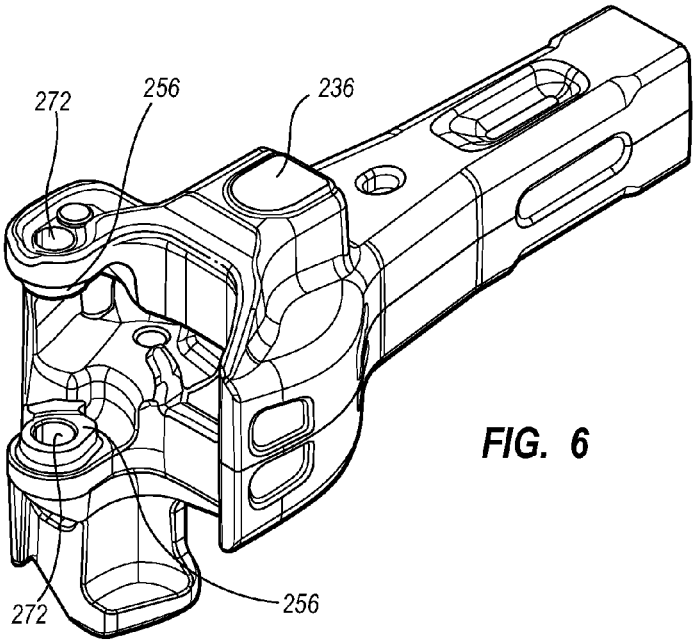
FIG. 6 is a perspective view of the railroad coupler of FIG. 2, showing the location of the pin protector bosses relative to the coupler pin hole.

FIGS. 5A and 5B are two perspective views of the coupler body 204 of FIG. 2, showing the location of the coupler buffing shoulders 260 relative to the coupler pin hole 272 achievable with the no-bake process. FIG. 6 is a perspective view of the railroad coupler of FIG. 2, showing the location of the pin protector bosses 256 relative to the coupler pin hole 272 achievable with the no-bake process.

Figure 7:
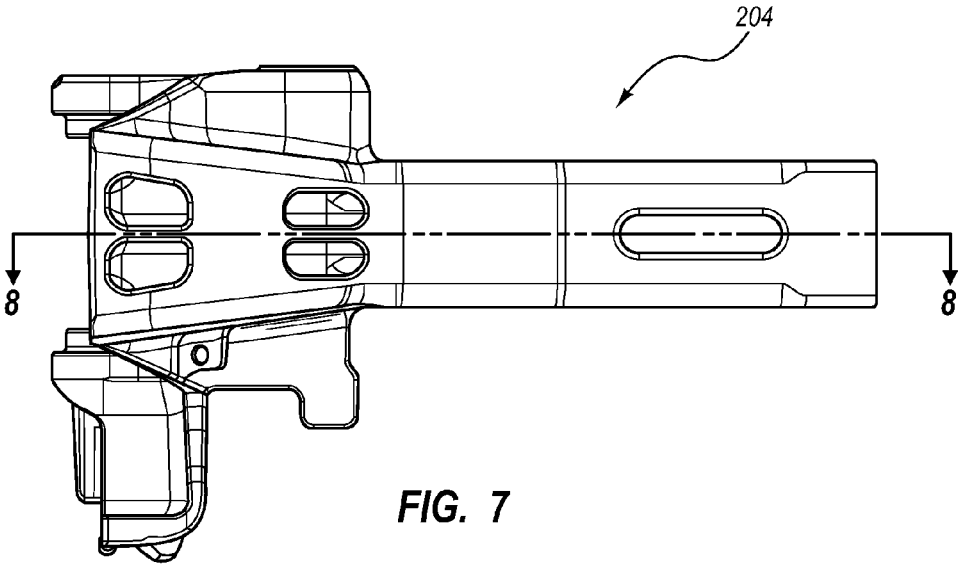
FIG. 7 is a side perspective view of the coupler body of FIG. 2.
Figure 8:
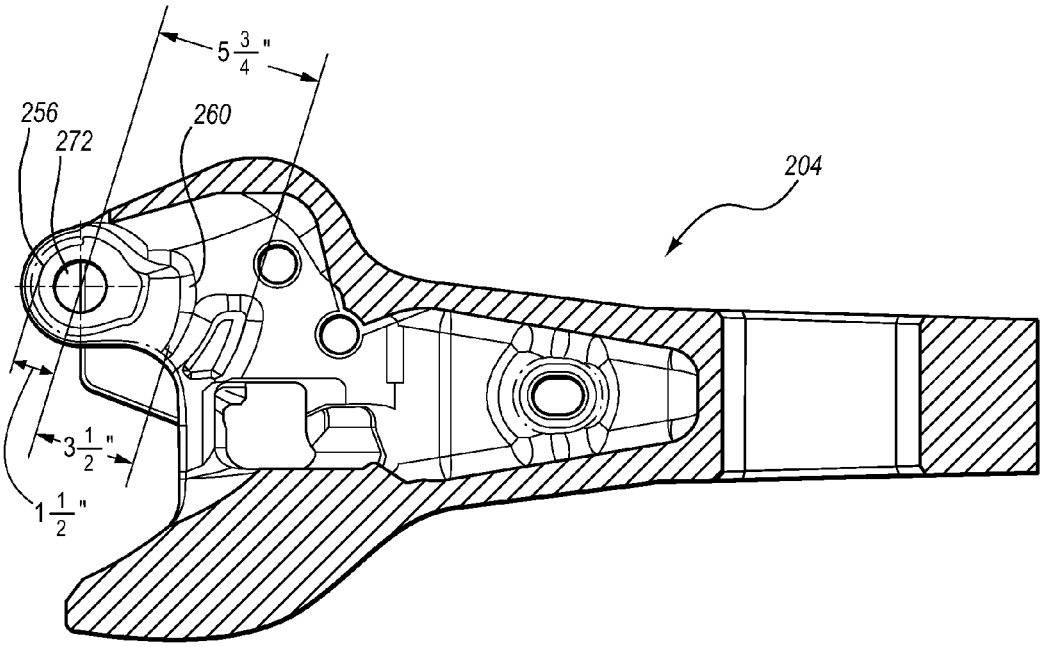
FIG. 8 is a cross section view along line 8-8 of the coupler body of FIG. 7.
Figure 9:
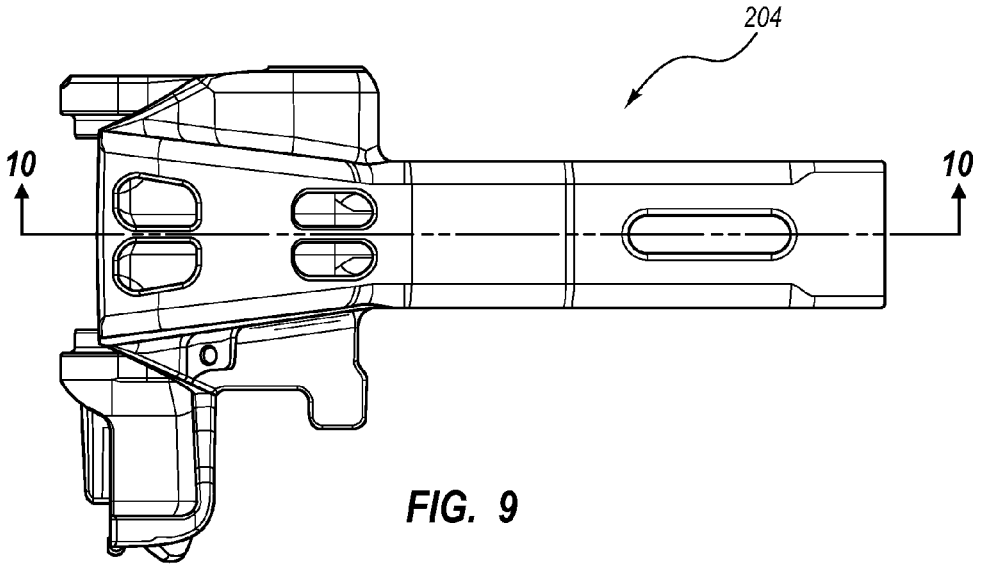
FIG. 9 is a side perspective view of the coupler body of FIG. 2.
Figure 10:
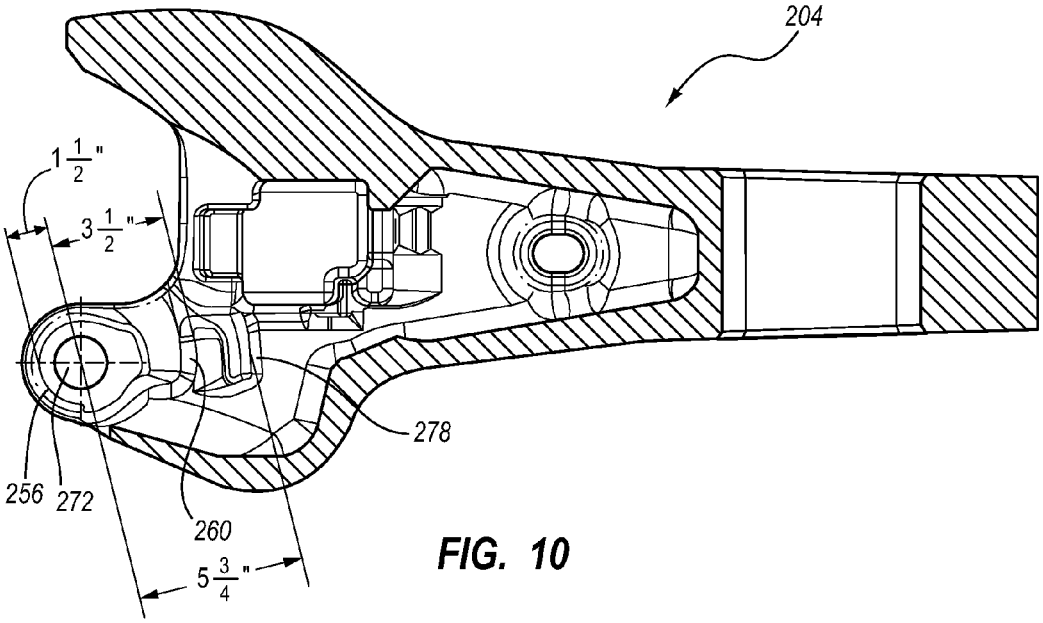
FIG. 10 is a cross section view along line 10-10 of the coupler body of FIG. 9.

FIG. 7 is a side perspective view of the coupler body 204 of FIG. 2. FIG. 8 is a cross section view alone line 8-8 of the coupler body of FIG. 7. FIG. 9 is a side perspective view of the coupler body 204 of FIG. 2. FIG. 10 is a cross section view alone line 10-10 of the coupler body 204 of FIG. 9, thus showing the cross section from the other side of the coupler body 204 from the line 8-8 view shown in FIG. 8. The dimension of 3½ inches in both FIGS. 8 and 10 is the approximate distance between the center of the coupler pin holes 272 and the coupler buffing shoulders 260, achievable with the no-bake process. Based on an approximate weight of 378 pounds, the tolerance of this dimension is approximately plus or minus 0.075 inches using Table 3. The tolerance that results from the green sand process results in about plus or minus 0.162 inches using Table 4. Accordingly, the tolerance achievable with the no-bake process is less than half that achievable using the green sand process.

Because one must round the weight up to 500 pounds and the length up to 4 inches in the example of FIG. 8 to use the AAR tables, the cited tolerances are but estimates and probably somewhat greater than reality in this case. For instance, the 3½ inch dimension yields a tolerance closer to plus or minus 0.070 inches. Also, because of the draft angles discussed above, and due to angled surfaces designed with some features, the dimension changes some throughout the measured features. Accordingly, the dimensions themselves vary to some degree and showing a specific length, or reciting a specific tolerance, should not be taken as exact values but as close approximations. Therefore, the difference between approximate tolerances between the no-bake and the green sand processes more accurately describes the improvement of using the no-bake process in terms of dimensional tolerances.

FIGS. 8 and 10 also show additional dimensions: 1 1; i inches between the center of the coupler pin holes 272 and the pin protector bosses 256 and 5% inches between the center of the coupler pin holes 272 and the pulling lugs 278 of the coupler body 204. Using the same 500 pound estimate, and rounding to 2 inches, the 1 1; i inch dimension in Table 3 indicates a tolerance of about plus or minus 0.068 inches, although in reality it is probably somewhat less, such as plus or minus 0.062 inches for the reasons discussed above. The corresponding tolerance from Table 4, using the green sand process, is approximately plus or minus 0.155 inches, which is more than twice that achievable from the no-bake process.

Using the same 500 pound estimate, and rounding to 6 inches, the 5¾ inch dimension in Table 3 indicates a tolerance of about plus or minus 0.080 inches. Because of rounding, this tolerance is probably closer to plus or minus 0.075 inches. The corresponding tolerance from Table 4 using the green sand process is about plus or minus 0.167 inches, again about twice that which is achievable using the no-bake process.

Figure 11:
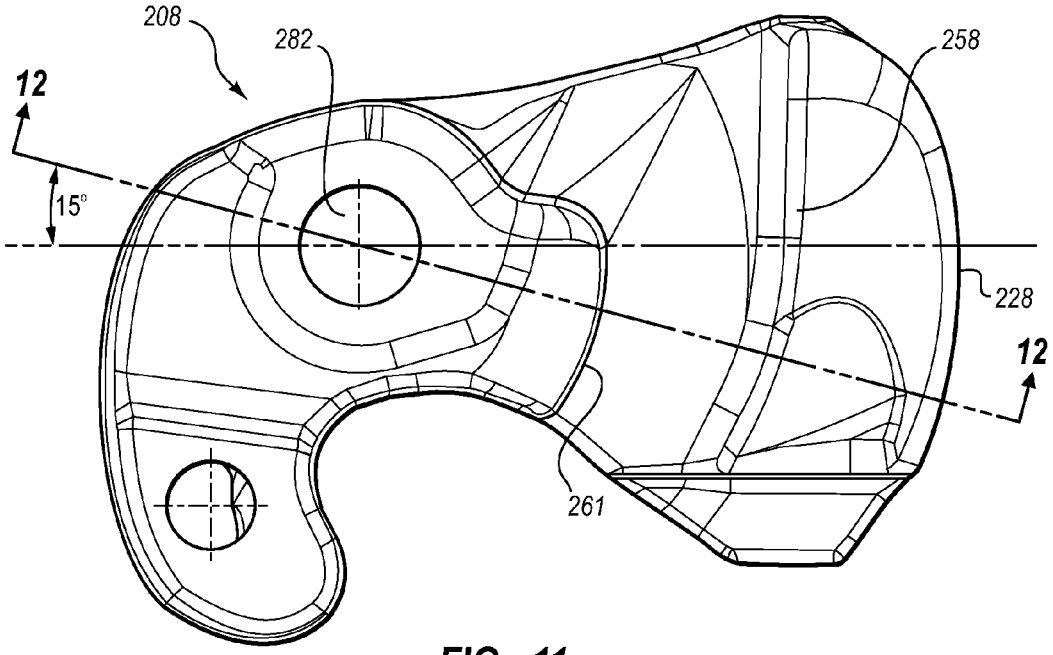
FIG. 11 is a top view of the coupler knuckle of FIG. 2.
Figure 12:
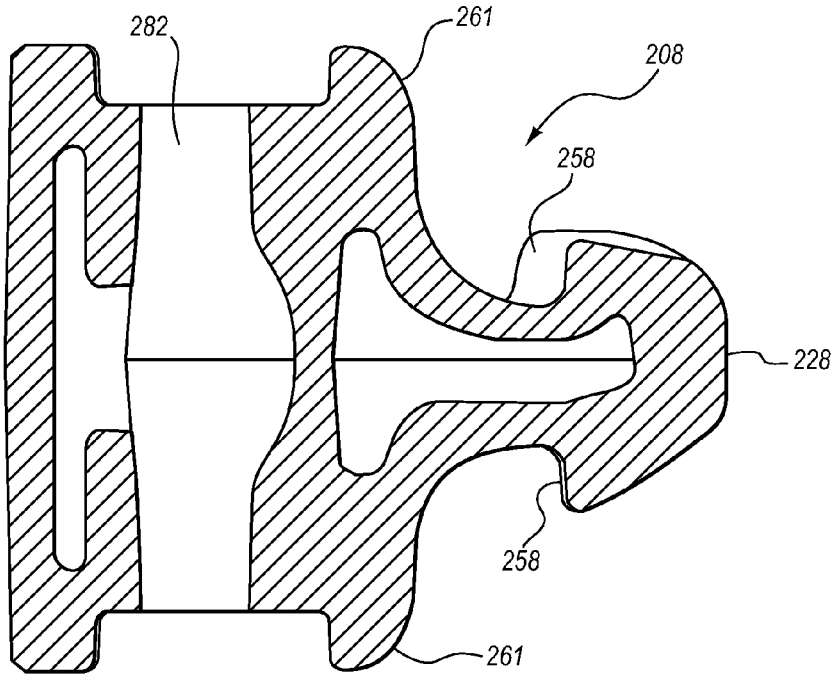
FIG. 12 is the cross section view along line 12-12 of the knuckle of FIG. 11.

FIG. 11 is a top view of the coupler knuckle of FIG. 2. FIG. 12 is the cross section view along line 12-12 of the knuckle of FIG. 11. FIGS. 11 and 12 show the knuckle pin hole 282 in relation to the knuckle buffing shoulders 261 and to the knuckle pulling lugs 258.

Figure 13A:
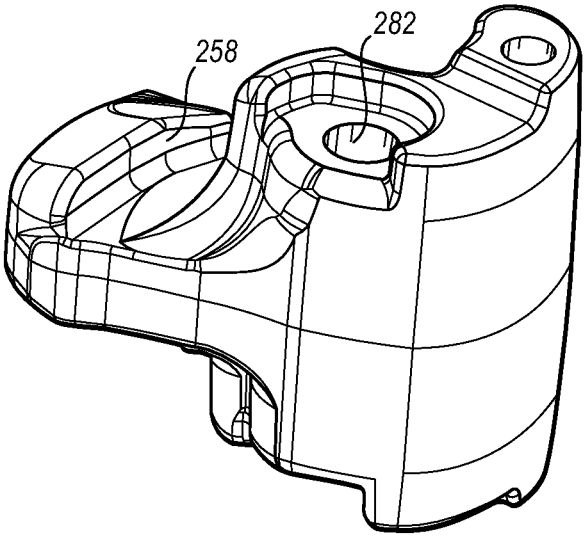
FIGS. 13A and 13B are two perspective views of the knuckle of the railroad coupler of FIG. 11, showing the location of the knuckle pulling lugs relative to the knuckle pin hole.
Figure 13B:
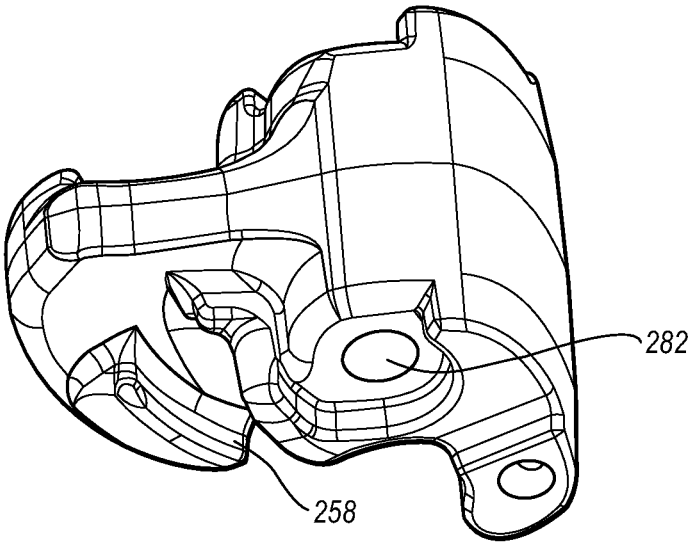
Figure 14A:
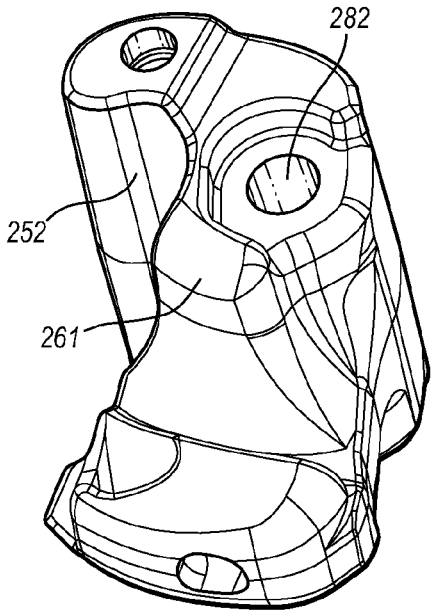
FIGS. 14A and 14B are two perspective views of the knuckle of the railroad coupler of FIG. 11, showing the location of the knuckle buffing shoulders relative to the knuckle pin hole.
Figure 14B:
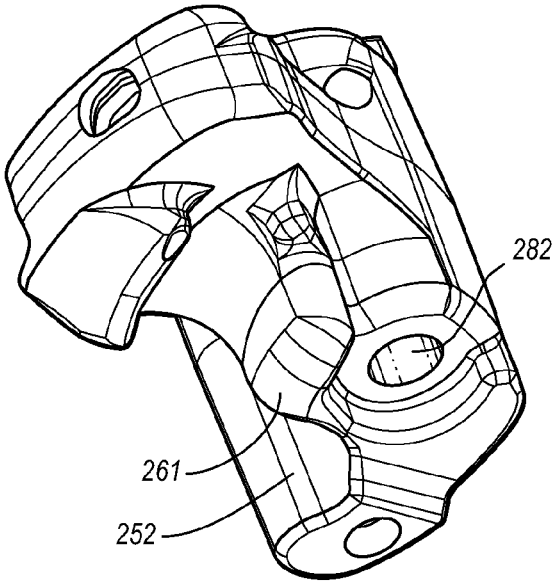
Figure 15A:
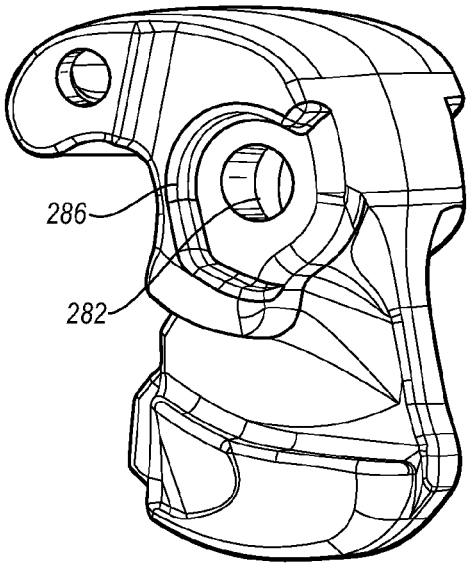
FIGS. 15A and 15B are two perspective views of the knuckle of the railroad coupler of FIG. 11, showing the location of the knuckle pin protector bosses relative to the knuckle pin hole.
Figure 15B:
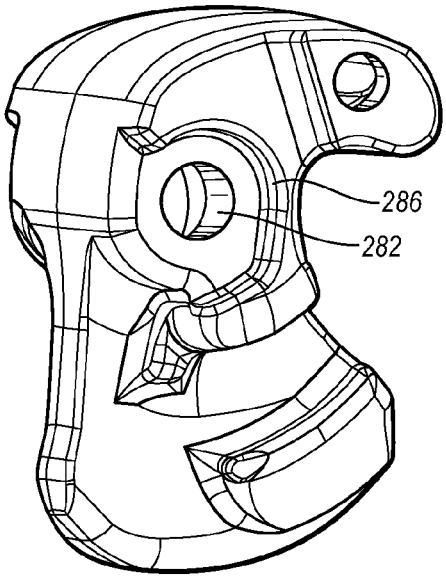

FIGS. 13A and 13B are two perspective views of the knuckle of the railroad coupler of FIG. 11, showing the location of the knuckle pulling lugs 258 relative to the knuckle pin hole 282 when formed by the no-bake process. FIGS. 14A and 14B are two perspective views of the knuckle of the railroad coupler of FIG. 11, showing the location of the knuckle buffing shoulders 261 relative to the knuckle pin hole 282 when formed by the no-bake process. FIGS. 15A and 15B are two perspective views of the knuckle of the railroad coupler of FIG. 11, showing the location of the knuckle pin protector bosses 286 relative to the knuckle pin hole 282 when formed by the no-bake process.

Figure 16:
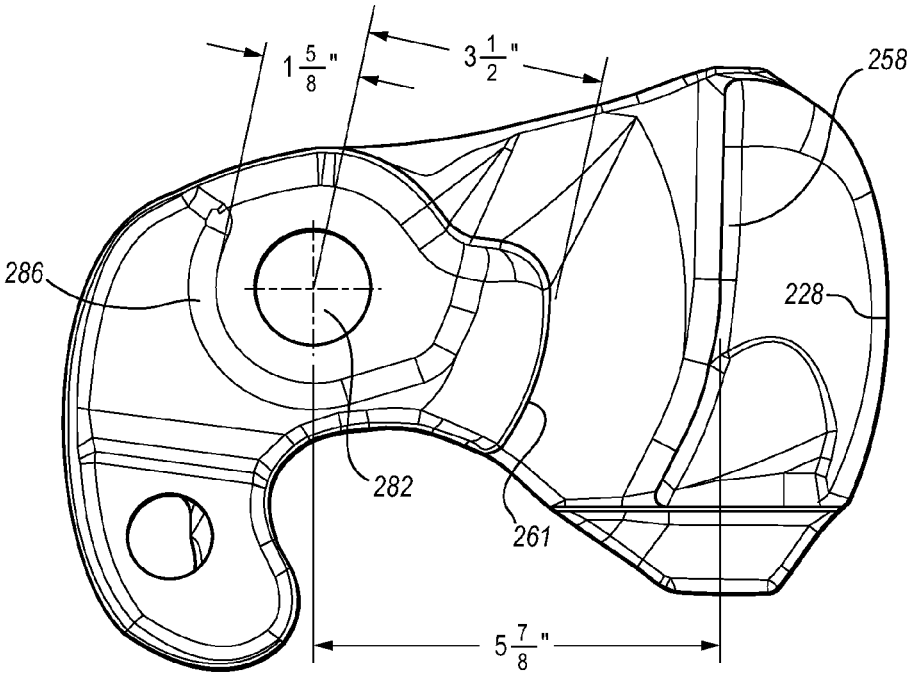
FIG. 16 is a top view of the coupler knuckle of FIG. 2, indicating the approximate dimension between the center of the knuckle pin hole and the knuckle buffing shoulder as about 3½ inches and between the center of the knuckle pin hole and the knuckle pulling lug as about 5⅞ inches.

FIG. 16 is a top view of the coupler knuckle of FIG. 2, indicating the approximate dimension between the center of the knuckle pin hole 282 and the knuckle buffing shoulder 261 as about 3½ inches; between the center of the knuckle pin hole 282 and the knuckle pulling lug 258 as about 5⅞ inches; and between the center of the pin hole 282 and the pin protector bosses 286 as about 1⅝ inches. With an approximate weight of the knuckle of about 86 pounds, the 3½ inch dimension would have a tolerance of about plus or minus 0.056 inches using the no-bake process compared to about plus or minus 0.103 inches for the green sand process. (In this case, the rounding causes the cited tolerances to be somewhat less than reality, but again these are close approximations.) The relative tolerances again indicate a nearly two-fold improvement in tolerance when using the no-bake process.

The 5⅞ inch dimension between the knuckle pulling lug 258 and the knuckle pin hole 282 results in a tolerance of about plus or minus 0.061 inches for the no-bake process compared to about plus or minus 0.108 inches for the green sand process, not quite a two-fold improvement. The 1⅝ inch dimension between the knuckle pin hole 282 and the pin protector bosses 286 results in a tolerance of about plus or minus 0.049 inches for the no-bake process compared to about plus or minus 0.095 inches for the green sand process, again about a two-fold improvement.

Figure 17:
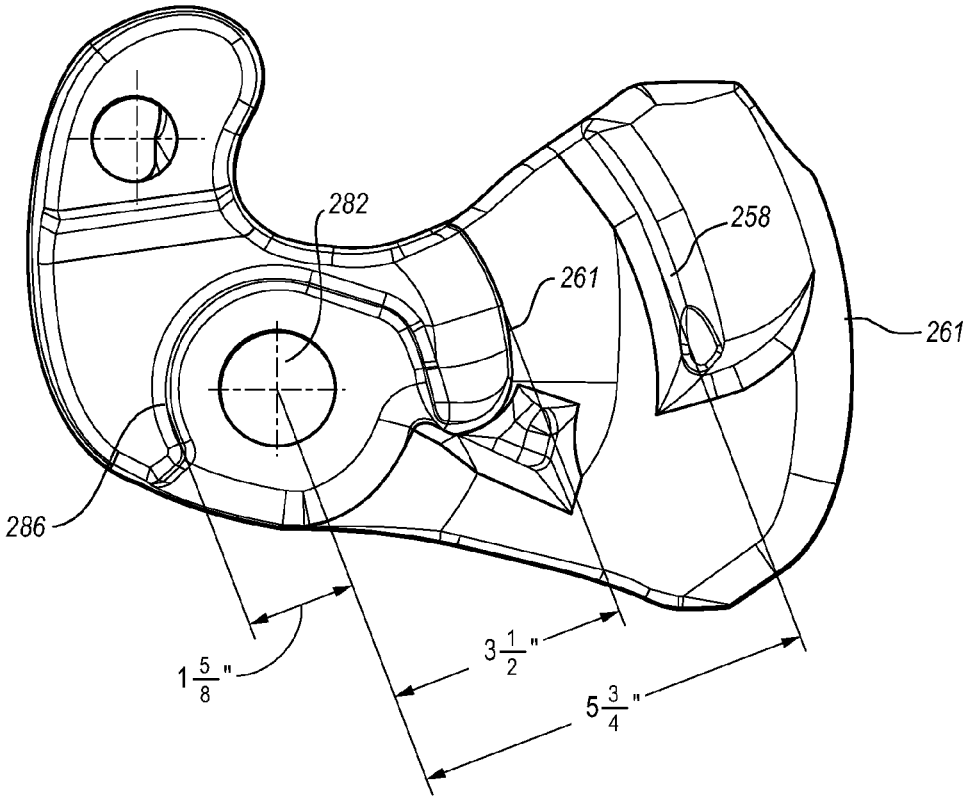
FIG. 17 is a bottom view of the coupler knuckle of FIG. 2, indicating the approximate dimension between the center of the knuckle pin hole and the knuckle buffing shoulder as about 3½ inches and between the center of the knuckle pin hole and the knuckle pulling lug as about 5¾ inches.

FIG. 17 is a bottom view of the coupler knuckle of FIG. 2, indicating the approximate dimension between the center of the knuckle pin hole 282 and the knuckle buffing shoulder 261 as about 3½ inches; between the center of the knuckle pin hole 282 and the knuckle pulling lug 258 as about 5¾ inches; and between the knuckle pin hole 282 and the pin protector bosses 286 of about 1⅝ inches. The only dimension that differs from those shown in FIG. 16 is the 5¾ inch dimension between the knuckle pin hole 282 and the knuckle pulling lug 258, which still results in a tolerance of about plus or minus 0.061 inches for the no-bake process compared to about plus or minus 0.108 for the green sand process, not a quite a two-fold improvement.

The terms and descriptions used herein are set forth by way of illustration only and are not meant as limitations. Those skilled in the art will recognize that many variations can be made to the details of the above-described embodiments without departing from the underlying principles of the disclosed embodiments. For example, the steps of the methods need not be executed in a certain order, unless specified, although they may have been presented in that order in the disclosure. The scope of the invention should, therefore, be determined only by the following claims (and their equivalents) in which all terms are to be understood in their broadest reasonable sense unless otherwise indicated.

The invention claimed is:

1. A method for casting a coupler body of a railroad coupler assembly, the method comprising:

manufacturing a coupler body made of steel in a no-bake manufacturing process including use of a chemically-bonded sand system that results in a sand mold from which the coupler body is cast, the coupler body defining pulling lugs, coupler pin holes, buffing shoulders and pin protector bosses;

wherein the pulling lugs of the coupler body manufactured in the no-bake manufacturing process are located relative to the coupler pin holes of the coupler body within about a plus or minus 0.075-inch tolerance;

wherein the buffing shoulders of the coupler body manufactured in the no-bake manufacturing process are located relative to the coupler pin holes of the coupler body within about a plus or minus 0.070-inch tolerance; and wherein the pin protector bosses of the coupler body manufactured in the no-bake manufacturing process are located relative to the coupler pin holes of the coupler body within about a plus or minus 0.062-inch tolerance.

2. The method of claim 1, wherein the surface condition of the coupler body in critical areas matches or is superior to SCRATA (Steel Castings Research and Trade Association) values comprising: B2 (surface inclusions); and C2 (gas porosity), wherein the SCRATA values are defined by SCRATA comparator plates referenced in the 1981 publication of SCRATA values.

3. The method of claim 2, wherein the coupler body manufactured in the no-bake manufacturing process has no observable laps, scabs, chaplets or welding in critical areas of the coupler body, which are reflected in surface conditions matching or superior to SCRATA (Steel Castings Research and Trade Association) values comprising: D1 (laps); E1 (scabs); F1 (chaplets); and J1 (welds), wherein the SCRATA values are defined by SCRATA comparator plates referenced in the 1981 publication of SCRATA values.

4. The method of claim 3, wherein the surface condition of the coupler body in critical areas matches or is superior to SCRATA (Steel Castings Research and Trade Association) values comprising: A1 (surface roughness), wherein the SCRATA values are defined by SCRATA comparator plates referenced in the 1981 publication of SCRATA values.

5. The method of claim 4, wherein the coupler body manufactured in the no-bake manufacturing process includes draft angles comprising 1.0 (one) degree or less for a plurality of typical features of the coupler body.

6. The method of claim 4, wherein the coupler body manufactured in the no-bake manufacturing process includes increased fatigue life compared to a coupler body manufactured by a green sand process.

7. The method of claim 1, wherein the surface condition of the coupler body in critical areas matches or is superior to SCRATA (Steel Castings Research and Trade Association) values comprising: A1 (surface roughness), wherein the SCRATA values are defined by SCRATA comparator plates referenced in the 1981 publication of SCRATA values.

8. A coupler body of a railroad coupler assembly, the coupler body comprising:

a head and a shank, the head including a lock chamber, a first buffing shoulder and a second buffing shoulder, a first pulling lug and a second pulling lug, and coupler pin holes extending through the head;

wherein the coupler body is manufactured according to the method of claim 1.

9. A method for casting a knuckle of a railroad coupler assembly, the method comprising:

manufacturing a knuckle made of steel in a no-bake manufacturing process including use of a chemically-bonded sand system that results in a sand mold from which the knuckle is cast, the knuckle defining pulling lugs, a knuckle pin hole, buffing shoulders and pin protector bosses;

wherein the pulling lugs of the knuckle manufactured in the no-bake manufacturing process are located relative to the knuckle pin hole within about a plus or minus 0.061-inch tolerance;

wherein the buffing shoulders of the knuckle manufactured in the no-bake manufacturing process are located relative to the knuckle pin hole within about a plus or minus 0.056-inch tolerance; and wherein the pin protector bosses manufactured in the no-bake manufacturing process are located relative to the knuckle pin hole within about a plus or minus 0.049-inch tolerance.

10. The method of claim 9, wherein the surface condition of the knuckle in critical areas matches or is superior to SCRATA (Steel Castings Research and Trade Association) values comprising: B2 (surface inclusions); and C2 (gas porosity), wherein the SCRATA values are defined by SCRATA comparator plates referenced in the 1981 publication of SCRATA values.

11. The method of claim 10, wherein the knuckle manufactured in the no-bake manufacturing process has no observable laps, scabs, chaplets or welding in critical areas of the knuckle, which are reflected in surface conditions matching or superior to SCRATA (Steel Castings Research and Trade Association) values comprising: D1 (laps); E1 (scabs); F1 (chaplets); and J1 (welds), wherein the SCRATA values are defined by SCRATA comparator plates referenced in the 1981 publication of SCRATA values.

12. The method of claim 11, wherein the surface condition of the knuckle in critical areas matches or is superior to SCRATA (Steel Castings Research and Trade Association) values comprising: A1 (surface roughness), wherein the SCRATA values are defined by SCRATA comparator plates referenced in the 1981 publication of SCRATA values.

13. The method of claim 12, wherein the knuckle manufactured in the no-bake manufacturing process includes draft angles comprising 1.0 (one) degree or less for a plurality of typical features of the knuckle.

14. The method of claim 12, wherein the knuckle manufactured in the no-bake manufacturing process includes increased fatigue life compared to a coupler body manufactured by a green sand process.

15. The method of claim 9, wherein the surface condition of the knuckle in critical areas matches or is superior to SCRATA (Steel Castings Research and Trade Association) values comprising: A1 (surface roughness), wherein the SCRATA values are defined by SCRATA comparator plates referenced in the 1981 publication of SCRATA values.

16. A knuckle of a railroad coupler assembly, the knuckle comprising:

a knuckle having a first knuckle pulling lug and a second knuckle pulling lug, a first buffing shoulder and a second buffing shoulder, and a knuckle pin hole extending through the knuckle;

wherein the knuckle is manufactured according to the method of claim 9.

17. A method of manufacturing a railcar casted steel part, the method comprising:

manufacturing the railcar casted steel part in a no-bake manufacturing process including use of a chemically-bonded sand system that results in a sand mold from which the railcar casted part is cast;

wherein the surface condition of the casted steel part in critical areas matches or is superior to SCRATA (Steel Castings Research and Trade Association) values comprising: B2 (surface inclusions); and C2 (gas porosity), wherein the SCRATA values are defined by SCRATA comparator plates referenced in the 1981 publication of SCRATA values.

18. The method of claim 17, wherein the surface condition of the railcar casted steel part in critical areas matches or is superior to SCRATA values further comprising: A1 (surface roughness).

19. The method of claim 17, wherein the railcar casted steel part manufactured in the no-bake manufacturing process includes increased fatigue life compared to a coupler body manufactured by a green sand process.

20. The method of claim 17, wherein the railcar casted part is a coupler body.

21. The method of claim 17, wherein the railcar casted part is a knuckle.

22. The method of claim 17, wherein the railcar casted part is a lock.

23. The method of claim 17, wherein the railcar casted part is a thrower.

24. The method of claim 17, wherein the railcar casted part is a lock lift.

25. The method of claim 17, wherein the railcar casted part that results in having dimensional tolerances that are within at least plus or minus 0.150 inches.

26. A railcar casted part, wherein the railcar casted part is manufactured according to the method of claim 25.

* * * * *